US006503096B2

(12) United States Patent
Aoki

(10) Patent No.: US 6,503,096 B2
(45) Date of Patent: Jan. 7, 2003

(54) CONNECTOR

(75) Inventor: Hiroshi Aoki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/781,307

(22) Filed: Feb. 13, 2001

(65) Prior Publication Data

US 2001/0018290 A1 Aug. 30, 2001

(30) Foreign Application Priority Data

Feb. 25, 2000 (JP) ..... 2000-049442

(51) Int. Cl.[7] ..... H01R 12/24
(52) U.S. Cl. ..... 439/496
(58) Field of Search ..... 439/496, 495, 439/492, 493, 499, 77

(56) References Cited

U.S. PATENT DOCUMENTS 4,639,063 A * 1/1987 Mueller ..... 439/325
4,934,947 A * 6/1990 Brummans et al. ..... 439/77
6,089,904 A * 7/2000 Wu ..... 439/495

FOREIGN PATENT DOCUMENTS

| | | |
|---|---|---|
| DE | 1465659 | 1/1970 |
| DE | 2545791 C2 | 5/1985 |
| DE | 8813507-1 | 1/1989 |
| JP | 62-165884 | 7/1987 |
| JP | 9-97655 | 4/1997 |
| JP | 9-330772 | 12/1997 |

* cited by examiner

*Primary Examiner*—Javaid Nasri
(74) *Attorney, Agent, or Firm*—Morgan, Lewis & Bockius LLP

(57) ABSTRACT

In a connector housing (15), slits (25) formed in outer walls are perpendicular to the terminal insertion direction, so that an FPC (40) that is passed through the slits (25) can be positioned at a predetermined location and arranged opposite conductor joints (37) of terminals (17). When a rear holder (19) for applying pressure to the FPC (40) that is passed through the slits (25) is shifted, the conductor joints (37) are bent, and that the recovery force produced by the bending holds the conductor joints elastically in contact with the FPC (40).

6 Claims, 5 Drawing Sheets

CONNECTOR

BACKGROUND OF INVENTION

1. Technical Field

The present invention relates to a connector used for a flexible print circuit or a flat cable, such as a flexible flat cable, and relates more specifically to a connector that furnishes a stable electric property by providing a secure connection for a cable.

2. Related Art

Because of their thin-plate structure, flat cables is useful for wiring in narrow spaces, further is useful for use with moving parts due to the their flexibility, for instance, wire harnesses for connection between electrical equipment mounted on the doors of vehicle and vehicle body, membrane switches for transmitting electric signals when seats are occupied, and lead lines for conveying such electric signals from the membrane switches to external receptacles.

A connector used for such a flat cable when connecting a cable of cables to electric equipment is disclosed, for example, in JP-A-62-165884, and will now be described while referring to FIGS. 7 and 8. A connector 1 comprises: a housing 5, in which multiple terminals are embedded using a molding process; a cover 7 covering a terminal joints. Terminals 3 are attached by reflow soldering to conductors (44 in FIG. 1) of a flat cable 40 which is disposed perpendicular to the axial direction of the terminals 3, and the cover 7 is fitted to the housing 5 to cover the soldered terminal joints.

In this connector 1, when the cover 7 is fitted onto the housing 5, tongue pieces 9 formed on the cover 7 are engage with protrusions 11 on the housing 5, while a flat cable 40 is bent into a U shape, following the outline of the terminals 3, to provide so-called strain relief, so that the flat cable 40 can be introduced from the rear of the connector 1. Thus, the removal of soldered joints is prevented during normal use and handling, and the safety of the terminal joint is ensured.

However, for a related connector, the aligning with connector terminals of conductors comprising a flat cable is difficult, and since arranging the flat cable relative to the connector terminals is such a complicated task, the operating efficiency is not satisfactory.

Since the cover must be securely fitted to the housing without a play between the parts, highly accurate sizing and positioning must be provided for the tongue pieces and the protrusions. That is, if the cover is loose, external tension applied to the cable will also be transferred to and adversely affect the terminal joints, so that the cable/joint connections will be unstable.

SUMMARY OF THE INVENTION

To solve this problem, it is one objective of the invention to provide a connector wherewith the conductors comprising a flat cable can be easily and accurately positioned opposite the terminals accommodated in a terminal accommodation chamber, and wherewith connection stability between the cable and the terminals can be continuously maintained, even when there is a slight play between the components.

To achieve the above objective, according to the invention, a connector comprises:

a connector housing;

a terminal accommodation chamber provided in the connector housing;

a terminal including an elastic conductor joint accommodated in the terminal accommodation chamber in a terminal insertion direction;

a pair of slits, which are adapted to be passed a flat cable therethrough, respectively formed in an opposite outer walls of the terminal accommodation chamber, wherein the flat cable is inserted in the pair of slits in a direction perpendicular to the terminal insertion direction; and a rear holder inserted into the connector housing being shiftable between and engageable at a temporary engagement position in which the flat cable is permitted to be inserted through the pair slits and a plenary engagement position wherein the rear holder and the an elastic conductor joint hold the flat cable.

When the flat cable has been passed through the pair of slits in the connector housing, and when the rear holder is shifted from the temporary engagement position to the plenary engagement position, the conductor joints is driven by the rear holder and the flat cable and are elastically bent. Then, since the recovery force produced by the bending of the conductor joint forces the joints against the flat cable, a good electrical connection can be established between the conductor joints and the flat cable.

According to the invention, in the connector of the first aspect, the base of the terminal is curved and U-shaped as the conductor joint, and when the curved faces are forcibly driven inward, the conductor joints are elastically bent.

When the base of the terminal is curved and U-shaped as the conductor joint, the curved faces, when contacted by the rear holder, are driven inward so that the conductor joints are is elastically bent. Further, the displacement value of the conductor joints can absorb the effect produces by size discrepancies between the terminals and the rear holder, so that stable contact between the terminals and the flat cable can be obtained.

According to the invention, in the connector of the first aspect, the width of the slits may be substantially equal to the width of the flat cable.

Since the widths of the slits substantially match the width of the flat cable, when the flat cable is passed through the slits, it is inscribed to the opening edges of the slits and its widthwise displacement is restricted. Thus, the flat cable can be positioned at a predetermined location, and can be arranged so that it is positioned precisely opposite the conductor joints of terminals accommodated in the terminal accommodation chamber.

DESCRIPTION OF PREFERRED EMBODIMENT

A connector according to the preferred embodiment of the invention will now be described in detail while referring to the accompanying drawings.

Figure 1:
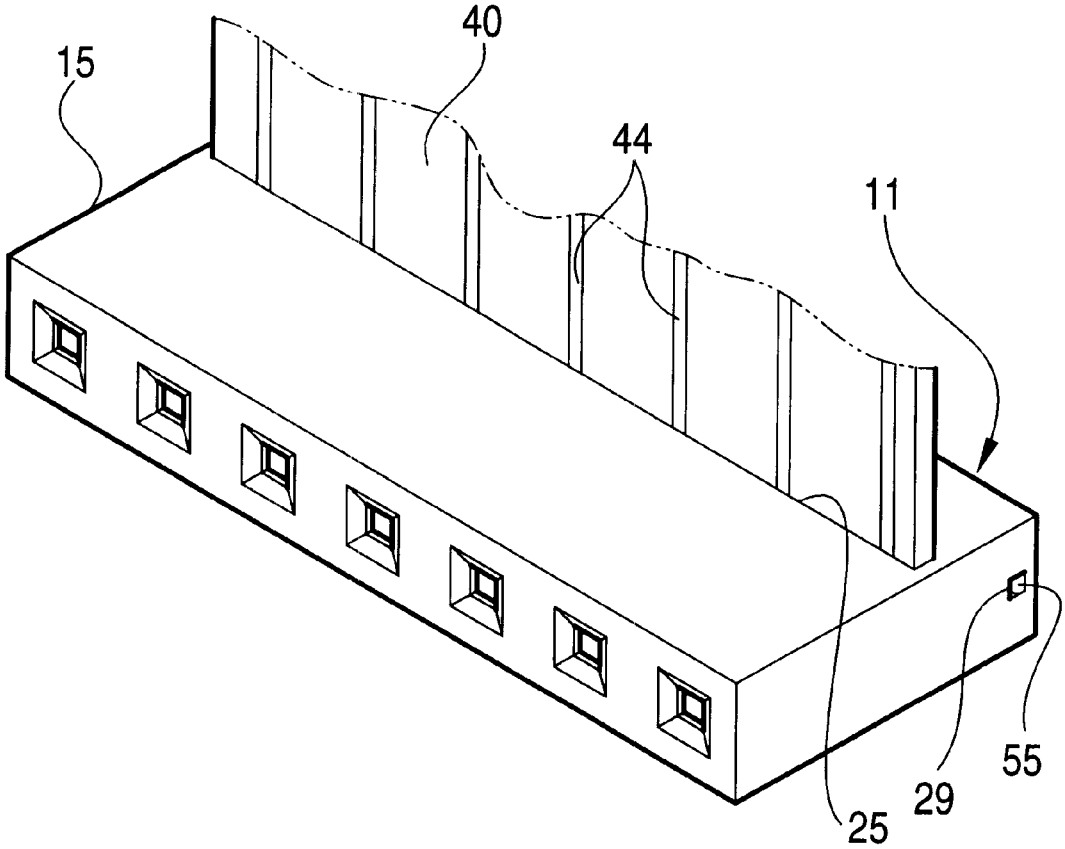
FIG. 1 is a perspective view of the external appearance of a connector according to the invention when a cable is connected thereto.
Figure 2:
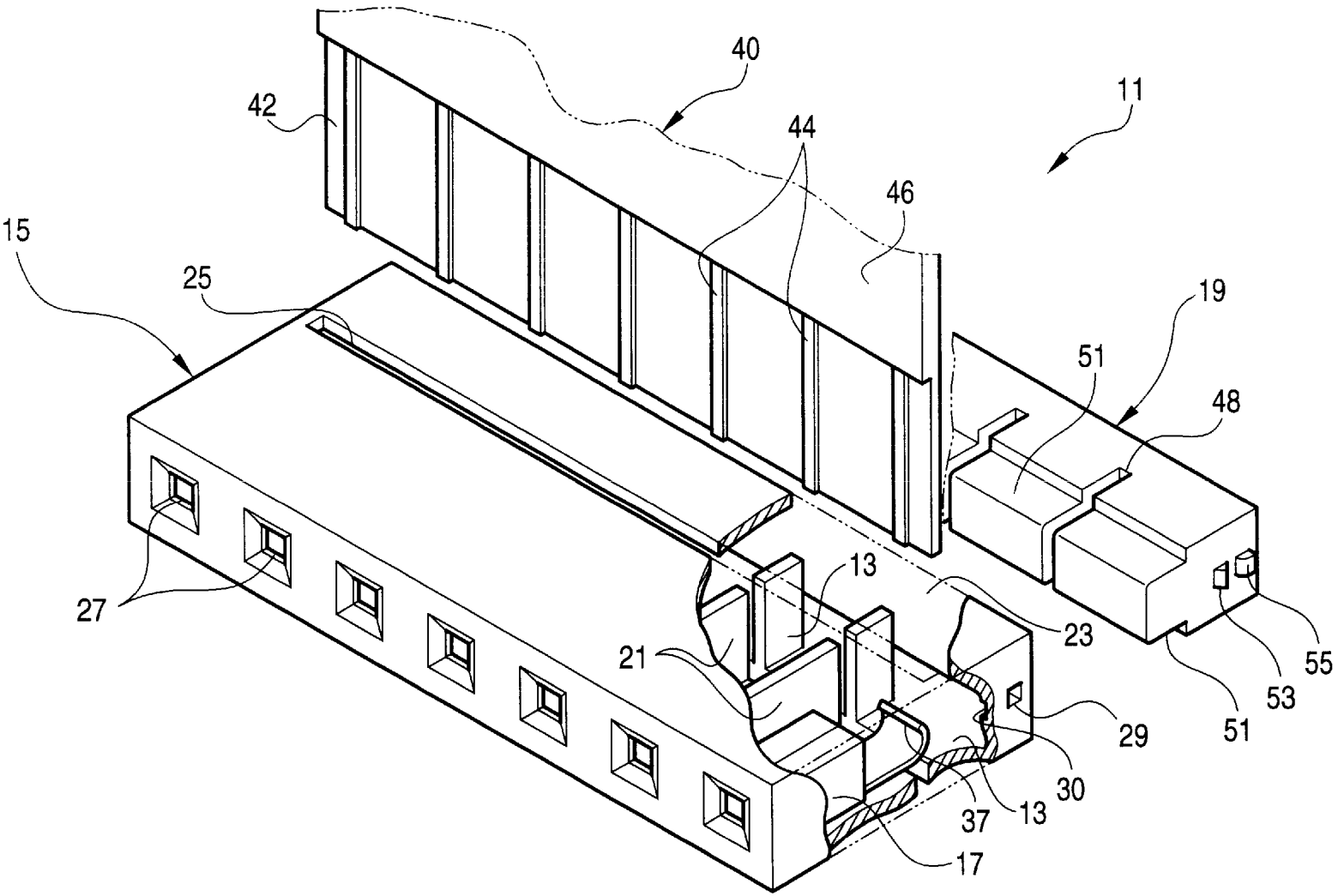
FIG. 2 is a partially cutaway, exploded perspective view of the connector in FIG. 1 before the cable is connected.
Figure 3:
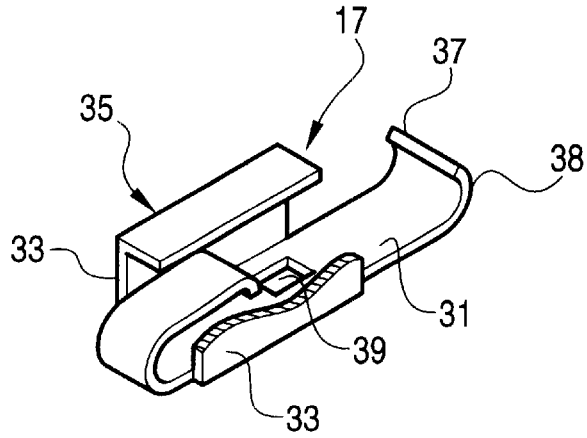
FIG. 3 is a partially cutaway, perspective view of a terminal used for the connector of the invention.
Figure 4:
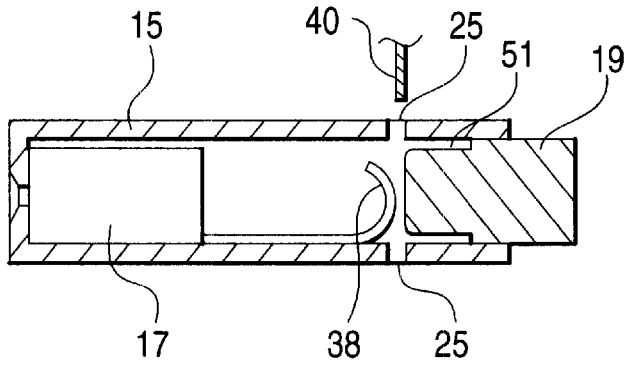
FIG. 4 is a cross-sectional view of the connector before the cable is connected, is used to explain the cable connection processing.
Figure 5:
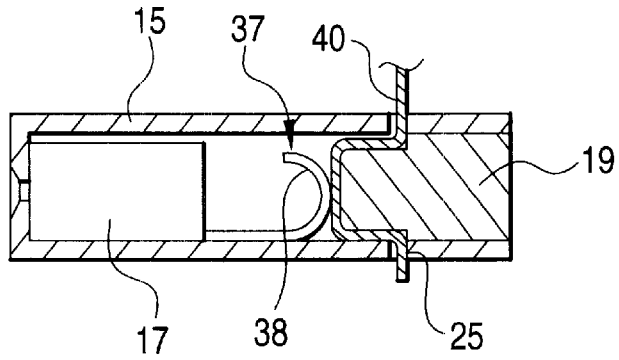
FIG. 5 is a cross-sectional view of the connector after the cable is connected, is used to explain the cable connection processing.

FIG. 1 is a perspective view of the external appearance of a connector according to the invention when a cable is connected thereto. FIG. 2 is an exploded perspective view of the connector before the cable is connected. FIG. 3 is a partially cutaway perspective view of a terminal used for the connector of the invention. FIG. 4 is a cross-sectional view of the connector assembling process wherein a rear holder is in a temporary engagement state. FIG. 5 is a cross-sectional view of the state wherein the rear holder is in the plenary engagement state.

In this embodiment, an explanation will be given for a case wherein a flexible printed circuit (hereinafter referred to as an FPC) is employed as the flat cable connected to the connector.

In FIG. 2, a connector 11 in this embodiment comprises: a connector housing 15, which has a substantially rectangular shape, wherein multiple terminal accommodation chambers 13 (seven in this embodiment) are horizontally arranged in a row; a plurality of terminals 17, which are to be accommodated in the terminal accommodation chambers 13; and a rear holder 19, which is to be fitted into the connector housing 15.

In the connector housing 15, which is formed of an insulating resin, the adjacent terminal accommodation chambers 13 are defined by partition walls 21, and the rear of the connector housing 15, which communicates with the terminal accommodation chambers 13, serves an opening 23 by omitting a back plate.

Slits 25 formed in the upper and lower outer walls are perpendicular to the direction in which the terminals 17 are inserted into the terminal accommodation chambers 13, and are located at positions that substantially corresponds to the rear ends of the terminals 17 in the terminal accommodation chambers 13. The slits 25 pass vertically through the connector housing 15 and the terminal accommodation chambers 13, and thus, each of the partition walls 21 are divided into a front portion and a rear portion at the positions corresponding to the slits 25.

In the connector housing 15, terminal insertion ports 27 through which other terminals are inserted are formed in the front wall portions corresponding to the terminal accommodation chambers 13. Through holes 29 for engaging the rear holder 19 are formed in the side walls. Recess portions 30 that are formed in the side walls and that are nearer the front than are the through holes 29.

The width of each slit 25 is substantially equal to the width of a FPC 40, which will be described later, so that the FPC 40 can be inserted while both of its sides gently contact the opening edges of the slits 25. Therefore, the FPC 40 can be accurately positioned at a predetermined location, while its actual displacement is restricted in the widthwise direction and corresponds to the horizontal direction (the direction in which the terminal accommodation chambers are arranged) of the connector housing 15.

The FPC 40 is so designed that a plurality of conductors 44 are patterned on a base film 42 and are covered with an insulating film 46. The insulating film 46 is removed from the distal end that is to be inserted into the slits 25, and the conductors 44 are exposed. Then, the FPC 40 is inserted through the slits 25 and is so positioned in the connector housing 15 that the exposed conductors 44 are arranged opposite the terminals 17 in the terminal accommodation chambers 13.

As shown in FIG. 3, a terminal 17 punched out of a single thin metal plate comprises an electric joint 35 and a conductor joint 37. The electric joint 35 is formed so that wing pieces 33 extending upward from a base 31 are bent into the shape of a frame, the distal end of the base 31 is folded over to form a U-shaped portion stored into the frame. The conductor joint 37 is formed so that the rear end of the base 31 extending from the electric joint 35 is folded over in substantially U-shape.

The conductor joint 37 has a curved face 38, which faces the slits 25 when a terminal 17 is accommodated in the terminal accommodation chamber 13. This curved face 38 can be elastically bent inward by pressure applied via the FPC 40, which will be described later. An engagement hole 39 is formed in the base 31 of the terminal 17, and when the elastic engagement arm (not shown) of a terminal accommodation chamber 13 is fitted into the engagement hole 39, the terminal 17 is securely retained in the connector housing 15 and is prevented from being removed therefrom.

As shown in FIG. 2, the rear holder 19 has substantially the same rectangular shape as has the opening 23 of the connector housing 15. The rear holder 19, which is fitted into the connector housing 15 through the opening 23, is slidable. And thus, notches 48, into which the partition walls 21 are inserted, are formed at locations corresponding to those of the partition walls 21.

Furthermore, step-shaped cable clearances 51 are formed at locations on the rear holder 19 that are near the distal ends of the upper and the lower outer walls.

In addition, when the rear holder 19 is fitted into the connector housing 15 and is gradually shifted from the temporary engagement state to the plenary engagement state, first protrusions 53 and second protrusions 55, which are sequentially arranged and project outward from the side walls of the rear holder 19 near the distal end, respectively engage the through holes 29 and the recessed portions 30 in the connector housing 15.

As is shown in FIG. 1, when the connector 11 is assembled, the FPC 40 is passed through the outer walls of the connector housing 15, perpendicular to the terminal insertion direction.

The assembly process for the connector 11 will now be described while referring to FIGS. 4 and 5.

During the assembly process for the connector 11, first, the terminals 17 are inserted through the openings 23 and are accommodated in the terminal accommodation chambers 13, and the elastic engagement arms are fitted into the engagement holes 39. Then, the rear holder 19 is fitted into the opening 23. At this time, the rear holder 19 is inserted only until the first protrusions 53 engage the through holes 29 in the connector housing 15, so that it is held in the temporary engagement state shown in FIG. 4.

In this temporary engagement state, a guide path that communicates with the slits 25 for the insertion of the FPC 40 is defined between the rear holder 19 and the curved face 38. Therefore, while the FPC 40 is inserted into the slits 25, it can smoothly pass through the connector housing 15, and the conductors 44 can be arranged opposite the curved faces 38.

Further, the FPC is continuously inserted until the distal end passes through the opposite slit 25 and projects out beyond the lower outer face of the connector housing 15. While in this state, the rear holder 19 is shifted so that the first protrusions 53 engage the recessed portions 30 of the connector housing 15, and the second protrusions 55 engage the through holes 29. As a result, the rear holder 19 is maintained in the plenary engagement state shown in FIG. 5.

When the rear holder 19 is set in the plenary engagement state, the FPC 40 is pushed inward into the connector housing and is bent by the distal end of the rear holder 19, while at the same time, the curved faces 38 of the conductor joints 37 are pushed inward and bent, elastically. Thereafter, the recovery force produced by the bending holds the connector joints 37 elastically in contact with the FPC 40, which is driven forward by the rear holder 19.

The effects produced by variations in manufacturing size tolerances between the terminals 17 and the rear holder 19 are easily absorbed due to the elastic reaction of the conductor joints 37, so that contact stability is constantly ensured. Further, since the FPC 40 is inscribed to the opening edges of the slits 25 and is held in a predetermined position, the conductors 44 can be easily and precisely arranged opposite the terminals 17. In addition, since the FPC 40 is driven while it passes through the connector housing 15 and projects out through the opposite slit 25, incomplete insertion of the FPC 40, or its slipping away from the curved faces 38 while being driven can be prevented.

While the rear holder 19 is shifted to the plenary engagement state, the FPC 40 is gradually stored in the cable clearances 51, so that the rear holder 19 can easily be shifted from the temporary engagement state to the plenary engagement state. Furthermore, the FPC 40 can easily be bent around the outer face of the rear holder 19.

Figure 6:
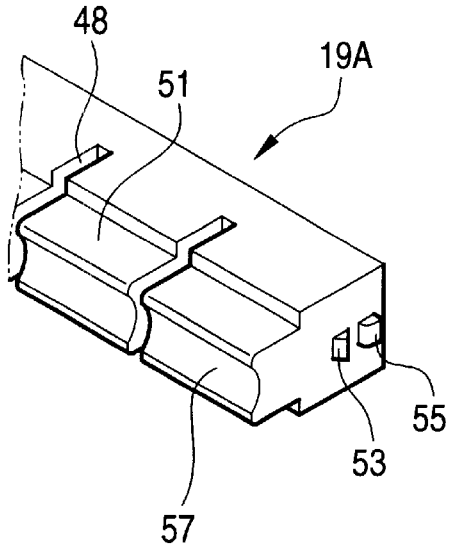
FIG. 6 is a perspective view of the external appearance of a modified rear holder.
Figure 7:
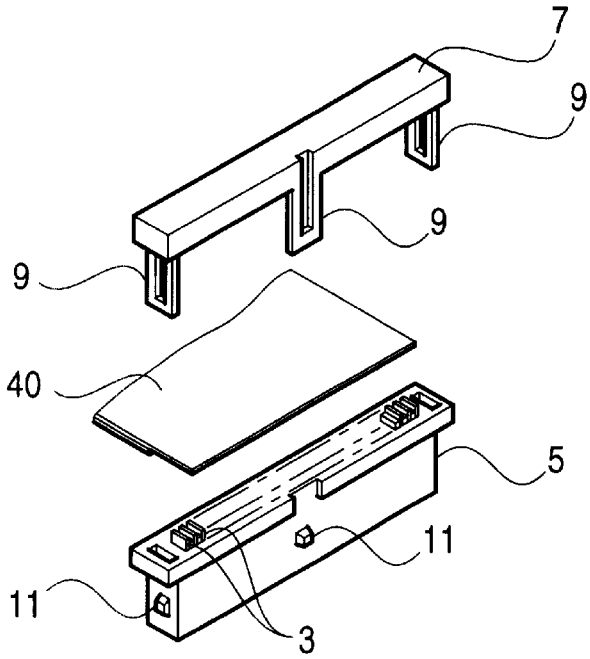
FIG. 7 is an exploded perspective view of a conventional connector.
Figure 8:
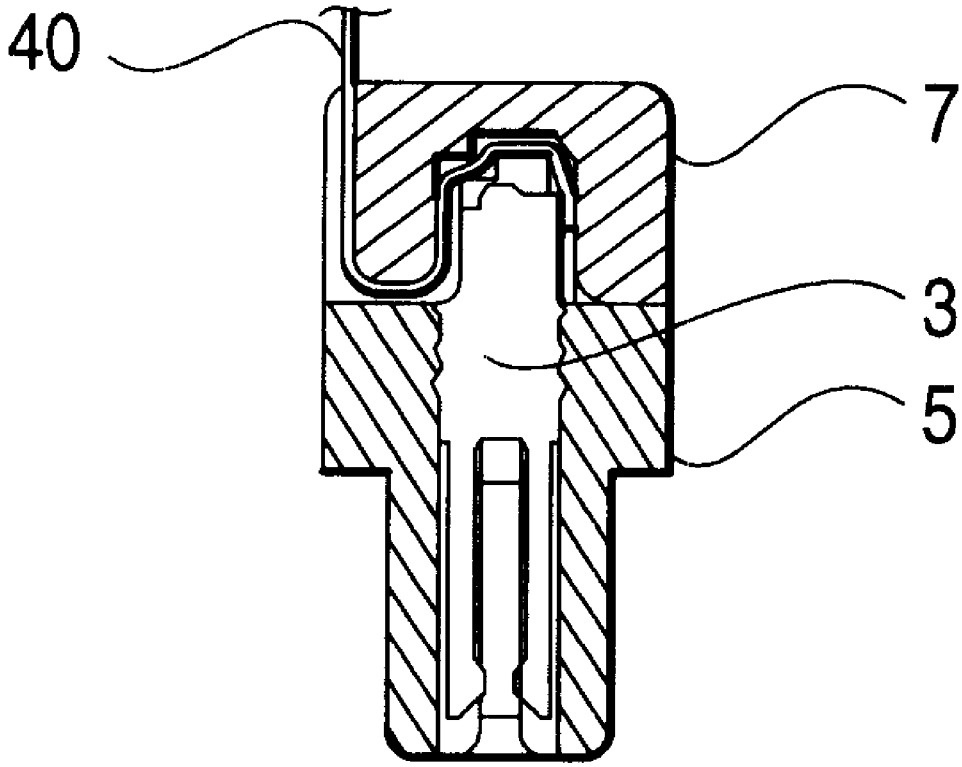
FIG. 8 is a cross-sectional view of the conventional connector 7 when the cable is connected thereto.

FIG. 6 is a diagram showing a modification of the rear holder.

A rear holder 19A is the same as the rear holder 19 in the embodiment, except for the shape of its distal end. Thus, the same reference numerals are used to denote corresponding components, and no further explanation for them will be given.

The distal end of the rear holder 19A is a curved face 57 that substantially corresponds to the curved faces 38 of the conductor joints 37 of the terminals 17. With this arrangement, when the rear holder 19A is driven against the curved faces 38 of the terminals 17, while the FPC 40 is held in contact with the curved face 57, the curved faces 38 of the terminals 17 slide along the curved face 57 and are easily folded over. Therefore, the shifting of the rear holder 19A can be performed more preferably, while at the same time, the implementation of the elastic contacts by the conductor joints 37 can be easily and exactly performed.

In this embodiment, the FPC that has been used is a flat cable. However, the employment of the connector of the invention is not limited to such a cable; it can also be employed with a flexible flat cable (FFC) produced by arranging multiple metal conductors on an insulating substrate.

As is described above, according to the connector of the invention, since a flat cable is inserted through slits in the connector housing, movement of the cable can be restricted, and the cable can be easily and precisely positioned opposite the terminals in the connector. Therefore, the pressure applied by the rear holder can electrically connect the flat cable to the terminals.

Further, since at their curved faces the conductor joints of the terminals are held elastically in contact with the flat cable, even when there are variations in the manufacturing tolerances provided between the terminals and the rear holder, contact stability is ensured and preferable connections can be made.

What is claimed is:

1. A connector comprising:

a connector housing;

a terminal accommodation chamber provided in the connector housing;

a terminal including an elastic conductor joint accommodated in the terminal accommodation chamber in a terminal insertion direction;

a pair of enclosed rectangular slits, which are adapted to pass a flat cable therethrough, respectively formed in opposite outer walls of the terminal accommodation chamber, wherein the flat cable is inserted in the pair of slits in a direction perpendicular to the terminal insertion direction; and a rear holder inserted into the connector housing being shiftable between and engageable at a temporary engagement position in which the flat cable is permitted to be inserted through the pair slits and a plenary engagement position wherein the rear holder and the elastic conductor joint hold the flat cable.

2. The connector according to claim 1, wherein the elastic conductor joint includes a substantially U-shaped curved face formed by curving a base portion of the terminal.

3. The connector according to claim 2, wherein the elastic conductor joint is elastically bent when the curved face is driven inward.

4. The connector according to claim 1, wherein a width of each of the pair of slits is substantially equal to a width of the flat cable.

5. A connector comprising:

a connector housing;

a terminal accommodation chamber provided in the connector housing;

a terminal including an elastic conductor joint accommodated in the terminal accommodation chamber in a terminal insertion direction;

a pair of slits, which are adapted to pass a flat cable therethrough, respectively formed in opposite outer walls of the terminal accommodation chamber, wherein the flat cable is inserted in the pair of slits in a direction perpendicular to the terminal insertion direction;

a rear holder inserted into the connector housing being shiftable between and engageable at a temporary engagement position in which the flat cable is permitted to be inserted through the pair slits and a plenary engagement position wherein the rear holder and the elastic conductor joint hold the flat cable;

wherein the elastic conductor joint includes a substantially U-shaped curved face formed by curving a base portion of the terminal; and a distal end of the rear holder has a curved face which substantially corresponds to the curved face of the elastic conductor joint.

6. A connector comprising:

a connector housing;

a terminal accommodation chamber provided in the connector housing;

a terminal including an elastic conductor joint accommodated in the terminal accommodation chamber in a terminal insertion direction;

a pair of enclosed rectangular slits, which are adapted to pass a flat cable therethrough, respectively formed in opposite outer walls of the terminal accommodation chamber, wherein the flat cable is inserted in the pair of slits in a direction perpendicular to the terminal insertion direction; and a rear holder inserted into the connector housing being shiftable between and engageable at a temporary engagement position in which the flat cable is permitted to be inserted through the pair slits and a plenary engagement position wherein the rear holder and the elastic conductor joint hold the flat cable;

wherein the flat cable is bent by a distal end of the rear holder when the rear holder is in the plenary engagement position.

* * * * *